United States Patent [19]

Downey

[11] Patent Number: 4,559,679

[45] Date of Patent: Dec. 24, 1985

[54] HELMUT STRAP FASTENER

[76] Inventor: Philip L. Downey, 244 Mercury Cir., Pomona, Calif. 91768

[21] Appl. No.: 571,733

[22] Filed: Jan. 18, 1984

[51] Int. Cl.[4] ..... A44B 11/25

[52] U.S. Cl. ..... 24/615; 24/573; 24/574; 24/617; 2/421

[58] Field of Search ..... 24/615, 616, 617, 618, 24/573, 574, 580, 164, 171, 192; 2/421

[56] References Cited

U.S. PATENT DOCUMENTS

| | | | |
|---|---|---|---|
| 684,497 | 10/1901 | Davies | 24/573 |
| 747,768 | 12/1903 | Requard | 24/573 |
| 1,361,645 | 12/1920 | Tomchin | 24/615 |
| 1,860,186 | 5/1932 | Kestenman | 24/615 |
| 2,664,610 | 1/1954 | Hanneman | 24/573 |
| 4,150,464 | 4/1979 | Tracy | 24/615 |
| 4,367,602 | 1/1983 | Petersen | 24/573 |

FOREIGN PATENT DOCUMENTS

| | | | |
|---|---|---|---|
| 677438 | 6/1939 | Fed. Rep. of Germany | 24/617 |
| 2812069 | 10/1979 | Fed. Rep. of Germany | 2/421 |
| 695075 | 12/1930 | France | 24/574 |
| 2451175 | 10/1980 | France | 24/616 |
| 2526646 | 11/1983 | France | 2/421 |

*Primary Examiner*—Victor N. Sakran

*Attorney, Agent, or Firm*—Charles H. Thomas

[57] ABSTRACT

A strap fastener for a motorcycle helmet is constructed of a unitary jacket that defines a hollow shell and latch tripping lever arms. A latching fork has a pair of resilient, generally parallel legs and can be slipped through a fabric loop which is attached to one side of the helmet. A fabric strap, secured to the other side of the helmet, is threaded through slots in a catch. The fork and catch are inserted into the jacket shell from opposite longitudinal directions. As the catch approaches the tips of the legs of the fork within the enclosure of the shell, it deflects feet defined upon the legs, overcoming the spring bias of the legs. When the catch is fully inserted, the feet of the fork legs spring back and engage hooks on the catch. The fork and the catch can be disengaged by depression of the lever arms on the jacket. The lever arms act through transverse apertures in the jacket. The lever arms act through transverse apertures in the jacket shell to overcome the spring bias of the legs to disengage the feet of the fork legs from the hooks on the catch.

8 Claims, 9 Drawing Figures

FIG. 4
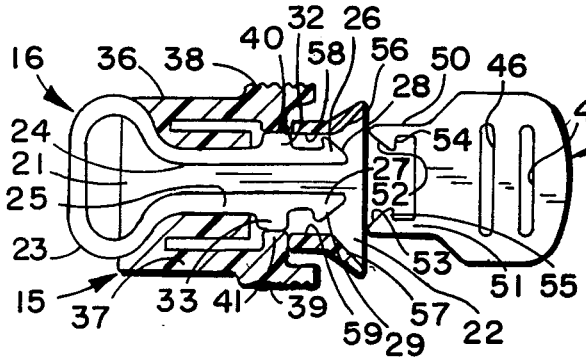
FIG. 5
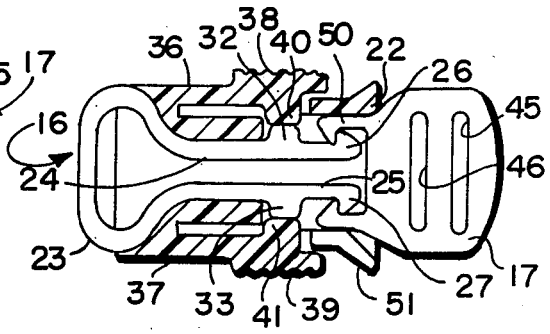
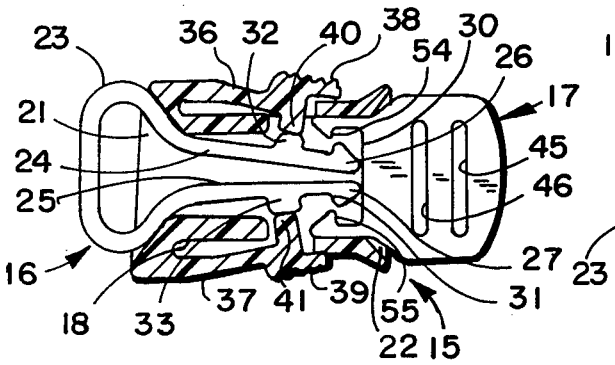
FIG.6
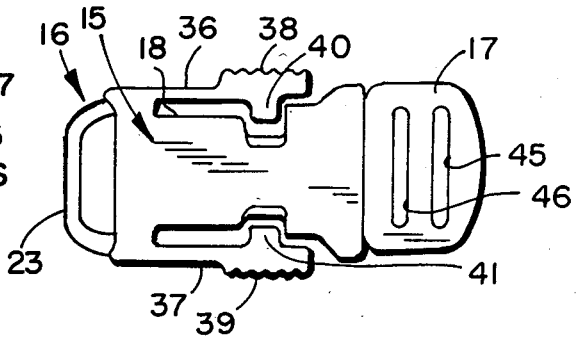
FIG. 7

HELMUT STRAP FASTENER

BACKGROUND OF THE INVENTION

1. Field of the Invention

The present invention relates to strap fasteners for use with motorcycle and other crash helmets.

2. Description of the Prior Art

There are numerous situations in which crash helmets are employed to protect the skull of a wearer. Crash helmets are very commonly used by motorcycle riders, but are also used in other situations where the risk of sudden impact to an individual's head is high. Different species of crash helmets are employed in certain sports, such as race car driving, football, roller skating and in other situations where an individual traveling at high speed is likely to be stopped abruptly. Crash helmets have saved countless lives where the skull of an individual would otherwise be crushed or the individual subjected to a severe head injury.

A crash helmet fits over the top of an individual's head and is secured thereto by means of a strap which passes from one side of the helmet to the other beneath the chin of the wearer. Helmet straps are typically formed of strips of heavy fabric which will not tear or separate from the helmet, even when subjected to extremely high impact.

Numerous different types of helmet strap fasteners have been devised, but certain design defects have persisted. Simple helmet strap fasteners are not able to sustain a sufficient impact to hold a helmet on the head of the wearer when subjected to severe stress. Conventional snap fasteners, velcro closures and wire clasps are simply unable to sustain the considerable impact to which motorcycle riders and others are sometimes subjected. As a consequence, simple, conventional helmet strap fasteners fail upon impact and the helmet is thus thrown from the head of the wearer.

More sturdy, but complex helmet strap fasteners are also deficient in a number of respects. While rugged, complex latching mechanisms have been designed which will withstand very significant impacts, such devices tend to be difficult to secure and release. Consequently, helmet wearers frequently neglect to secure strap fasteners of this type, due to the difficulty in manipulating the interengageable parts thereof. Furthermore, even when a helmet strap fastener of this type is utilized, severe injury can sometimes result due to an inability to release the helmet quickly following impact. As an example, highly combustible fuel may be thrown upon the surface of the helmet, and can even enter the helmet through the face and neck openings therein. In such a circumstance, it is absolutely necessary for the helmet strap fastener to be released in an instant so that the helmet can be taken off. However, conventional, complex helmet strap fasteners can be released only with considerable difficulty.

SUMMARY OF THE INVENTION

One object of the present invention is to provide a helmet strap fastener which will not fail when subjected to sudden and extreme stress, but which can be released instantly when desired. The helmet strap fastener of the invention is extremely rugged and highly durable, yet is remarkably simple in construction and manner of operation.

According to the invention, a helmet strap fastener is formed of three essential component parts. It includes a unitary body member, a fork, and a catch.

The body member defines an enclosure having openings at two opposite longitudinal ends. The body member also defines a transversely deflectable latch release means which is operable externally from the enclosure. The fork is a sturdy, yet resilient structure, preferably formed of spring steel. The fork has a loop for securement to one side of the helmet and a pair of resilient legs for insertion into one of the openings at one of the ends of the enclosure of the body member shell. The catch is likewise preferably a steel structure arranged for securement to the other side of the helmet. The legs of the fork and the catch form parts of an interengageable latch mechanism which are coupled together by insertion of the fork and the catch into the longitudinal openings of the body member at the opposite ends thereof. However, the latch release means is operable to quickly disengage the parts of the latch mechanism, when desired.

One very significant advantage of the present invention is that the fork can be threaded through a fabric loop, which is provided as a standard means of attachment on one side of the helmet. Conventional fastener elements which can be threaded through the loop usually include a D-ring, which is a wire hook shaped in the form of a D and split at the center. Since the ends of the hook are not attached to anything, they present points of weakness. A wire hook which is threaded through a fabric loop in a helmet terminates in a pair of free ends, so as to allow it to be threaded onto the fabric loop. When an impact occurs, the free ends of the D-ring straighten, allowing the fabric loop to slide off of the D-ring when the strap is subjected to only a moderate amount of tension.

In contrast, although the fork of the invention includes a free end when threaded through a fabric loop secured to the helmet, the ends of the fork do not remain free when the helmet is used. To the contrary, in preferred forms of the invention, both ends of the fork terminate in legs having transversely turned feet. Both of the feet are engaged with corresponding hooks or bearing surfaces, defined on the catch. When the fork and the catch are engaged together within the enclosure defined within the unitary body member, they form an endless steel loop. There is no free end which can be straightened when subjected to sudden, severe stress. Rather, the fork and the catch combine to form a steel loop which is completely closed and which does not present locations of weakness which are characteristic of prior helmet strap fasteners.

Another feature of the preferred forms of the invention is that the legs of the fork have transversely extending knees defined thereon, as well as feet with transverse bearing ledges. The knees on the spring steel legs of the fork serve a dual purpose. The knees project into transverse openings in the shell formed by the body member. As a consequence, proper longitudinal alignment of the fork within the body member is assured. As the fork is inserted into the enclosure defined within the shell of the body member, the spring bias of the fork legs must be overcome. The knees on the legs are deflected, overcoming the normal spring biased parallel disposition of the fork legs as the legs are moved into the enclosure. When the knees reach the transverse apertures, however, they are free to spring transversely outwardly, thereby assuring proper longitudinal positioning of the fork within the body member.

In the preferred embodiment of the invention, the knees on the fork legs also perform a second function. The body member is preferably equipped with arms which branch from the structure of the shell, preferably near one end of the body member. The arms extend to at least longitudinal alignment with the transverse openings in the body member and to the knees of the fork in registration therein. When the arms of the body member are squeezed together, they are forced inwardly toward the center of the body member and bear against the opposite knees on the fork legs. The knees of the fork legs are forced together, but the feet at the extremities of the legs are forced even closer together. As a consequence, the catch can be easily released in an instant. Accidental release is highly improbable, on the other hand, because release can only be effectuated with opposing, squeezing pressure on opposite sides of the body member.

The invention can be described with greater clarity and particularity by reference to the accompanying drawings.

BRIEF DESCRIPTION OF THE DRAWINGS

FIG. 4 shows the fork in position within the body member prior to insertion of the catch of the helmet strap fastener of FIG. 3.

FIG. 5 shows the strap fastener after insertion of the catch.

FIG. 6 illustrates the manner of releasing the catch.

FIG. 7 is a top plan view showing the helmet strap fastener latched as in FIG. 5.

DESCRIPTION OF THE EMBODIMENTS

Figure 1:
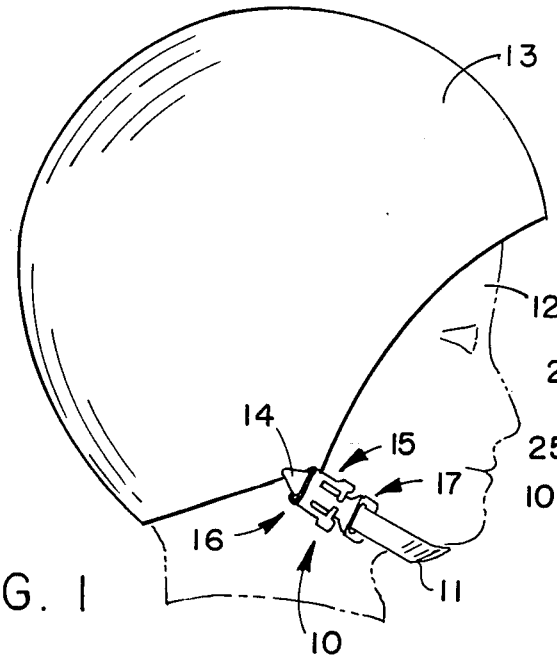
FIG. 1 shows a motorcycle helmet on the head of a wearer with a strap secured by the helmet strap fastener of the invention.

FIG. 1 shows a helmet strap fastener 10 used to secure a fabric strap 11 in place beneath the chin of the head 12 of a wearer. A motorcycle crash helmet 13 is positioned atop the crown of the head 12 of the wearer and the helmet strap fastener 10 is used to secure the long fabric strap 11 attached to one side of the helmet 13 to a very short triangular shaped fabric strap 14 on the opposite side of the helmet 13. The component parts of the helmet strap fastener 10 are shown separated from each other in FIG. 3. The helmet strap fastener 10 is comprised of a unitary body or jacket 15, a first resilient latching member 16 in the form of a fork, and a second latching member 17 which serves as a catch.

The unitary body or jacket 15 is an injection molded plastic structure which includes a hollow shell 18 defining an elongated enclosure 20 having openings 21 and 22 at its opposite longitudinal ends. The opening 21 is designed to receive the latching fork 16, while the opening 22 is configured to receive the latching catch 17.

The fork 16 is a structure stamped from a sheet of flat, stainless, spring steel. The fork 16 defines a transversely oriented obloid loop 23 which is designed to reside within a tubular loop sewn into the short plastic strap 14. From the loop 23 the ends of the fork 16 extend longitudinally as a pair of generally parallel legs 24 and 25 which define transversely outturned feet 26 and 27 at their respective extremities. The tips of the feet 26 and 27 define sloping surfaces 28 and 29 which diverge relative to the axis of symmetry of the structure of the fork 16. The feet 26 and 27 also define transverse bearing ledges 30 and 31 which return from the outer extremities of the sloping surfaces 28 and 29 and which face back toward the opening 21 in the shell 18 when the legs 24 and 25 of the fork 16 are inserted into the opening 21.

The legs 24 also include transversely outwardly projecting knees 32 and 33. The knees 32 and 33 are tab-like structures which project transversely outward on opposite sides of the fork 16.

The shell 18 of the jacket 15 defines a pair of transversely directed openings 34 and 35 on opposite sides of the enclosure 20. The openings 34 and 35 are longitudinally aligned with each other. The jacket 15 also is formed with a pair of latch tripping arms 36 and 37 which are joined at shoulders to the shell 18 at the opening 21, and which branch from the remaining portion of the body member 15 and extend longitudinally in the direction of the end of the shell 18 at which the opening 22 is located to at least the transverse openings 34 and 35. Knurled finger rests 38 and 39 face transversely outwardly in opposite directions near the free extremities of the arms 36 and 37. Inwardly directed latch tripping lugs 40 and 41 project transversely toward the axis of symmetry of the body member 15. The latch tripping lugs 40 and 41 are longitudinally aligned with the openings 34 and 35 in the shell 18. The latch tripping lugs 40 and 41 are also longitudinally aligned with the knees 32 and 33 on the legs 24 and 25 of the fork 16 when the fork 16 is inserted into the opening 21, as depicted in FIG. 4. The free extremities of the arms 36 and 37 are deflectable toward the shell 18 in registration with the transverse openings 34 and 35. When the knurled finger rests 38 and 39 are compressed transversely together toward the axis of symmetry of the fork 16, the latch tripping lugs 40 and 41 contact the knees 32 and 33 to squeeze the legs 24 and 25 toward each other, as illustrated in FIG. 6. The knees 32 and 33 normally project into the transverse openings 34 and 35 unless the feet 26 and 27 of the legs 24 and 25 are squeezed so closely together that they contact each other.

Figure 3:
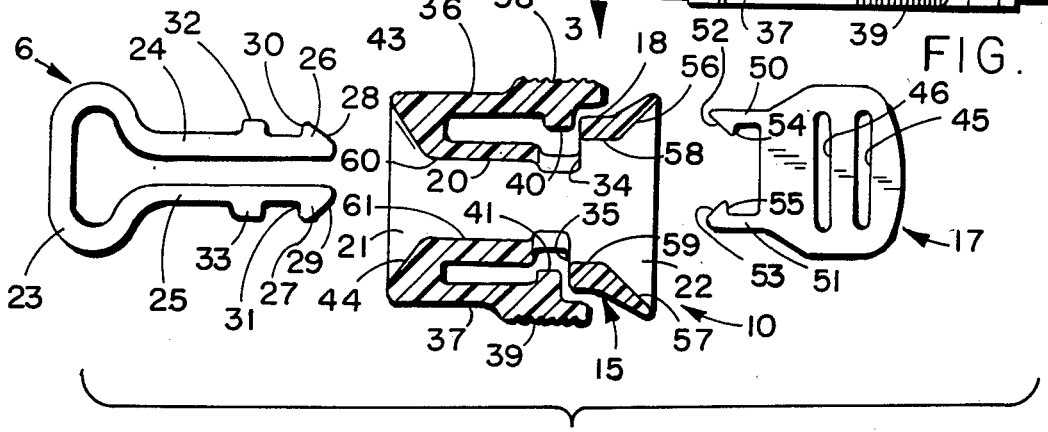
FIG. 3 is an exploded sectional plan view of the components of the strap fastener taken along the lines 3—3 of FIG. 2.

The interior structure of the enclosure 20 is formed with transversely inwardly sloping walls 43 and 44 at the opening 21. The walls 43 and 44 coact with the sloping surfaces 28 and 29 of the feet 26 and 27 of the fork 16 to deflect the fork legs 24 and 25 toward each other when the fork 16 is inserted into the body member 15. As longitudinal force is exerted to bring the fork 16 and the body member 15 together from a state of separation, as depicted in FIG. 3, to a position of engagement, as depicted in FIG. 4, the feet 26 and 27 are squeezed into contact with each other by the walls of the enclosure 20. When the legs 24 and 25 are partially inserted into the enclosure 20, the walls of the enclosure 20 bear upon the knees 32 and 33, as well as the feet 26 and 27, to prevent the feet 26 and 27 from springing transversely outwardly when they reach longitudinal alignment with the openings 34 and 35 in the shell 18. The feet 26 and 27 can only spring transversely outwardly away from contact with each other when the knees 32 and 33 reach longitudinal alignment with the openings 34 and 35. Thereupon, the knees 32 and 33 are released and spring outwardly into engagement with the openings 34 and 35, as depicted in FIG. 4.

The catch 17 is a flat structure stamped from a sheet of stainless steel. The catch 17 includes a relatively broad portion into which a pair of narrow, transverse slots 45 and 46 are defined. The slots 45 and 46 are parallel and coextensive with each other and are perpendicular to the alignment of the fork 16, the body member 15 and the catch 17.

The catch 17 also includes a pair of longitudinally projecting hooks 50 and 51. The hooks 50 and 51 have diverging, transversely sloping inwardly facing surfaces 52 and 53. As best depicted in FIGS. 3 and 4, the tips of the hooks 50 and 51 are of wedge shaped configuration. Behind the sloping surfaces 52 and 53 the structure of the hooks 50 and 51 defines transverse, bearing ledges 54 and 55.

The transverse walls 56 and 57 of the opening 22 in the body member 15 slope inwardly in converging fashion as illustrated. When the catch 17 is inserted into the opening 22 the sloping surfaces 56 and 57 guide the tips of the hooks 50 and 51 into proper position to engage the feet 26 and 27, respectively, of the fork 16. The hooks 50 and 51 just clear the linearly extending sections 58 and 59 of the walls bounding the enclosure 20.

To use the helmet strap fastener 10 one of the legs 24 or 25 is first threaded through a transversely extending loop in the short fabric strap 14. The structure of the fork 16 is worked around the fabric loop until that loop bears against the back of the loop 23 of the fork 16.

The fabric strap 11 is threaded through the slots 45 and 46 in a conventional manner so as to lock the fabric strap 11 in the slots 45 and 46 in the catch 17 when tension is exerted on the strap 11.

The fork 16 is then inserted into the opening 21 in the body member 15, where it normally remains undisturbed. In inserting the feet 26 and 27 into the opening 21, the sloping surfaces 28, 43 and 29, 44 coact to resiliently deflect the feet 26 and 27 toward each other. As the structure of the fork 16 is moved further inwardly toward the opening 22 at the opposite end, the force of the longitudinal sections 60 and 61 of the walls of the enclosure 20 against the feet 26 and 27 and the knees 32 and 33 of the fork 16 maintains the legs 24 and 25 deflected transversely toward each other. When the knees 32 and 33 arrive at the openings 34 and 35, however, the resiliency of the spring steel of the fork 16 causes the legs 24 and 25 to spring outwardly so that the knees 32 and 33 thereof reside in registration in the openings 34 and 35 in the body member 15, as illustrated in FIG. 4.

To fasten the strap sections 11 and 14 of the helmet 13 together, the catch 17 is then moved into position as illustrated in FIG. 4, and inserted into the opening 22 in the body member 15, as illustrated in FIG. 5. The sloping surfaces 28, 52 and 29, 53 on the fork 16 and the catch 17 slide past each other so that the hooks 50 and 51 serve as wedges to again deflect the feet 26 and 27 of the fork legs 24 and 25 toward each other. The fork 16 is maintained longitudinally immobilized, however, since the knees 32 and 33 are not forced toward each other a sufficient distance to disengage from the openings 34 and 35 in the body member 15. Once the catch 17 has been forced sufficiently into the opening 22 so that the pairs of corresponding abutment ledges 30, 54 and 31, 55 are in longitudinal alignment, the feet 26 and 27 of the fork 16 spring outwardly. Thereupon, the bearing ledges 30 and 31 of the fork 16 reside in juxtaposed abutment against the bearing ledges 54 and 55 on the catch 17, as depicted in FIG. 5.

With the fork 16 and catch 17 locked together as depicted in FIG. 5, an entire closed, steel loop is formed by the structure of the fork 16 through the feet 26 and 27 and through the hooks 50 and 51 and the structure of the catch 17. A loop of metal is thereby formed which will not give way even under extreme tensile force. The confining walls of the enclosure 20 snugly receive both the fork 16 and the catch 17. The fork 16 and catch 17 therefore cannot shift or twist within the body member 15. As a result, the interfacing pairs of bearing ledges 30, 54 and 31, 55 cannot slide past each other.

It should be noted that the loop 23 of the fork 16 has a relatively long, transverse back which is received within a fabric loop in the short fabric strap 14. Under extreme force, the elongated back of the fork loop 23 will bow toward the fabric strap 14. The force exerted in inelastically deforming the loop 23 is therefore energy which is dissipated, and not passed on to the helmet 13 or to the head 12 of the wearer.

Although the fork 16 and catch 17 will tenaciously grip each other when latched together as depicted in FIG. 5, they can easily be separated if so desired by the wearer. To disengage the fork 16 from the catch 17, the wearer merely squeezes transversely with thumb and forefinger on the finger rests 38 and 39 of the arms 36 and 37 of the body member 15. The arms 36 and 37 are thereby resiliently deflected toward each other at the transverse openings 34 and 35 in the manner depicted in FIG. 6. When the arms 36 and 37 are resiliently deflected transversely inwardly, as depicted in FIG. 6, the lugs 40 and 41 bear upon the knees 32 and 33, respectively, of the fork legs 24 and 25. The fork loop 23 acts as a fulcrum, so that the fork feet 26 and 27 are forced even closer together than are the knees 32 and 33. When the finger rests 38 and 39 are pressed so that the arms 36 and 37 contact the outer surface of the shell 18, the pairs of bearing ledges 30, 54 and 31, 55 no longer reside in abutting contact. To the contrary, the hooks 50 and 51 will just clear the fork feet 26 and 27 when the legs 24 and 25 are resiliently deflected as depicted in FIG. 6. The catch 17 can then be pulled out of the opening 22 to disengage the straps 11 and 14 from each other.

When the fork 16 and the catch 17 are inserted into the openings 21 and 22 in the body member 15, respectively, as depicted in FIG. 5, they form parts of an interengagable latch mechanism. The feet 26 and 27 and the hooks 50 and 51 are coupled together by insertion into the openings 21 and 22, respectively, at the opposite ends of the body member 15. When the latch releasing levers 36 and 37 are resiliently pressed transversely towards each other, as illustrated in FIG. 6, the parts of the latch mechanism are released and disengaged from each other.

Figure 9:
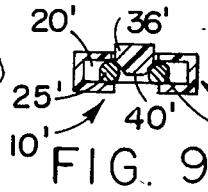
FIG. 9 is a transverse sectional view taken along the lines 9—9 of FIG. 8.
Figure 8:
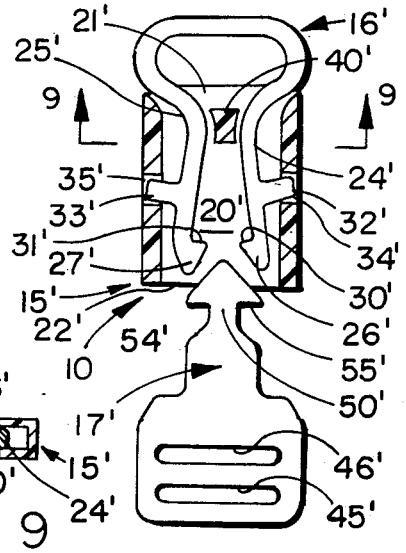
FIG. 8 is a sectional plan view illustrating an alternative embodiment of the helmet strap fastener of the invention.
Figure 2:
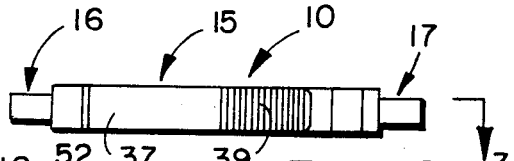
FIG. 2 is a side elevational view of the strap fastener of FIG. 1.

An alternative embodiment of the helmet strap fastener of the invention is depicted at 10' in FIGS. 8 and 9. The functionally equivalent parts of this embodiment are indicated by primed numbers corresponding to their unprimed equivalents in the embodiment of FIGS. 1–7.

The helmet strap fastener 10' differs from the helmet strap fastener 10 in that the catch 17' employs but a single hook 50' having a pair of transverse bearing ledges 54' and 55' on its opposite sides. The feet 26' and 27′ of the fork 16′ are not turned outwardly, but instead turn inwardly to engage the bearing ledges of the hook 50′. Also, a single latch tripping or decoupling lug 40′ is provided on a single lever arm 36′ to effectuate disengagement of the fork 16′ from the catch 17′. The lever arm 36′ branches from the body member 15′ near the opening 22′ into which the catch 17′ is inserted. The lever arm 36′ extends back toward the opening 21′ on the outside of the body member 15′, and the lug 40′ is of wedge shaped configuration, as best depicted in FIG. 9.

To disengage the feet 26′ and 27′ of the fork 16′ from the bearing ledges 54′ and 55′ of the hook 50′, the lever 36′ is resiliently deflected toward the enclosure 20′. The wedge shaped latch tripping or decoupling lug 40′ forces the legs 24′ and 25′ transversely away from each other until the feet 26′ and 27′ release the hook 50′. The catch 17′ can thereupon easily be removed from the body member 15′.

When the lever arm 36′ is released, it will spring outwardly away from the enclosure 20′, carrying with it the latch tripping or decoupling lug 40′. When the legs 24′ and 25′ of the fork 16′ are thus released, they will return to the disposition depicted in FIG. 8.

Numerous other variations and modifications of the invention will become readily apparent to those familiar with helmet strap fasteners. Accordingly, the scope of the invention should not be construed as limited to the specific embodiments depicted and described, but rather is defined in the Claims appended hereto.

I claim:

1. A helmet strap fastener comprising:

a unitary molded body member defining an enclosure having end openings at two opposite longitudinal ends, a pair of transverse openings on opposite sides, and transversely deflectable latch release means operable externally from said enclosure and including inwardly directed lugs longitudinally aligned with said transverse openings, a spring steel fork having a loop for direct securement to a load bearing member anchored to one side of a helmet and a pair of resilient legs for insertion into one of said end openings of said enclosure, each leg defining a transversely turned foot having a bearing ledge at the leg extremity, and a transversely outwardly projecting knee between said loop and said bearing ledge, wherein said knees of said legs project into said transverse openings in said body member and longitudinally immobilize said fork relative to said body member unless said feet are brought together by deflection of said legs transversely toward each other, and a steel catch for securement directly to a load bearing member anchored to another side of said helmet, said catch including means to transversely deflect and engage said feet when said fork and said catch are moved toward each other in said enclosure, whereby said feet of said fork legs and said catch form parts of an interengageable latch mechanism which are coupled together by insertion into said end openings at said opposite ends of said body member and said latch release means is operable by inward deflection of said lugs to bear against said knees to resiliently deflect said legs, to disengage said parts of said latch mechanism.

2. A helmet strap fastener according to claim 1 in which said latch release means further includes a pair of lever arms which branch from the remainder of said body member at one end thereof and which extend longitudinally to define said lugs, whereby said lever arms are resiliently deflectable toward each other at said transverse openings to operate said lugs to disengage said feet from said catch.

3. A helmet strap fastener according to claim 1 in which said means on said catch includes at least one wedge and at least a pair of hooks.

4. A helmet strap fastener comprising:

a unitary molded jacket defining a hollow shell having end openings at two opposite longitudinal ends and a pair of longitudinally aligned transverse openings on opposite sides, and an externally actuable latch tripping means disposed on said shell and including inwardly directed lugs in longitudinal alignment with said transverse openings biased transversely outwardly to a deactuating position and operable to move transversely relative to said shell, a first latching member constructed of spring steel having a loop for securement directly to a load bearing member anchored to one side of a helmet and having a pair of legs extending longitudinally into said shell and held longitudinally immobilized therewithin by a pair of knees defined on said legs which are resiliently biased into said transverse openings, each leg further defining a transversely turned foot at the tip thereof at a distance from the knee thereon, and a second latching member having means for securement directly to a load bearing member anchored to another side of said helmet and having catch means engageable with said feet of said latching member, wherein actuation of said latch tripping means drives said lugs towards each other to bear against said knees to resiliently deflect said legs to disengage said feet of said first latching member from said catch means.

5. A helmet strap fastener according to claim 4 in which a pair of arms are formed on said jacket to extend longitudinally on opposite sides of said shell, and said arms carry said lugs.

6. A helmet strap fastener comprising:

a unitary molded jacket defining an enclosure having end openings at opposite longitudinal ends to receive latching members inserted therein and having longitudinally aligned transversely directed opening means, and having resilient, decoupling means with inwardly directed lug means at said transversely directed opening means operable to move transversely relative to said enclosure, a first resilient latching member having a fastening portion protruding from one end opening of said enclosure for direct securement to a load bearing member anchored to one side of a helmet and having leg means extending into said one end opening and defining at the extremity of said leg means at least one transverse latching bearing ledge facing said one end opening, and defining knee means between said fastening portion and said transverse bearing ledge, and said knee means projects into said transverse opening means and longitudinally immobilizes said first resilient latching member relative to said jacket, and a second latching member having a fastening portion for direct connection to a load bearing member anchored to another side of said helmet and protruding from the other of said opposite end openings, and including a catch for insertion into said other of said opposite end openings for transversely deflecting said leg means of said first latching member to releasably interengage said bearing ledge with said catch, and wherein said decoupling means is operable to move said lug means in said transversely directed opening means to deflect said leg means to decouple said bearing ledge from said catch.

7. A helmet strap fastener according to claim 6 in which said leg means is comprised of a pair of legs, both having transversely turned feet each forming an aforesaid transverse bearing ledge thereon, and said catch of said second latching member has a pair of hooks for engaging said transverse bearing ledges.

8. A helmet strap fastener according to claim 7 in which the tips of said hooks are wedge-shaped.

* * * * *